United States Patent [19]

Zelder

[11] 4,390,048

[45] Jun. 28, 1983

[54] METHOD AND DEVICE FOR RECOVERING AN INERT GAS

[75] Inventor: Felix Zelder, Langenlonsheim, Fed. Rep. of Germany

[73] Assignee: Seitz-Werke GmbH, Bad Kreuznach, Fed. Rep. of Germany

[21] Appl. No.: 277,717

[22] Filed: Jun. 26, 1981

[30] Foreign Application Priority Data

Jun. 27, 1980 [DE] Fed. Rep. of Germany ..... 3024099

[51] Int. Cl.[3] ..... B65B 55/24; B67C 3/06

[52] U.S. Cl. ..... 141/6; 141/39; 261/DIG. 7; 261/79 A

[58] Field of Search ..... 261/DIG. 7, 79 A; 55/204; 141/4–7, 37–66, 285–310, 85, 89, 90, 91, 92

[56] References Cited

U.S. PATENT DOCUMENTS 2,810,406 10/1957 De Milleville ..... 141/6

*Primary Examiner*—Houston S. Bell, Jr.

*Attorney, Agent, or Firm*—Becker & Becker, Inc.

[57] ABSTRACT

A method of recovering inert gas used during a filling process for pressurizing containers which are to be filled with a liquid. The method includes the steps of expelling the air found in the container, and pressurizing the container, with a mixture of air and heavy inert gas; filling the container with the liquid and thus expelling the pressurizing gas mixture; centrally collecting the expelled mixture from a plurality of containers and conveying the mixture to at least one accumulator; subjecting the pressurizing gas mixture in the at least one accumulator to at least one gravity effect for partially separating off the lighter gas components and producing a mixture of predominantly inert gas; adding additional inert gas to a mixture of predominantly inert gas; and returning the resulting mixture to the filling process, at least as a pressurizing gas mixture, for use with subsequent containers which are to be filled. Also provided is a device for carrying out this method for one or more counterpressure filling machines.

36 Claims, 7 Drawing Figures

57
53
56
57
54
59
65
61
59
63
55
42
41
40
45
40
46
58
64
60
58
7
62
43
66
40
35
31
32
15
34
35
37
38
36
31

METHOD AND DEVICE FOR RECOVERING AN INERT GAS

The present invention relates to a method and a device for recovering an inert gas, in particular carbon dioxide, used during an automatic filling operation for pressurizing containers to be filled with a liquid. In particular, the present method relates to filling containers with a liquid, particularly beverages, by expelling the air existing inside the container and pressurizing the inside of the container with a mixture of air and a heavy inert gas, for instance carbon dioxide, before the liquid enters. The pressurizing gas mixture expelled from inside the container being filled with a liquid is collected and used in part for rinsing the air out of the next container to be filled.

In order to improve the taste stability of beverages filled into closed containers, a number of methods have been proposed which reduced to a minimum any contact of the beverages with the atmospheric air. German Auslegeschrift No. 1 207 230 describes a method with which the containers to be filled are emptied and then filled temporarily with an inert gas. During the filling of the container, this gas together with the remaining air flows from the container into the gas chamber of the container holding the liquid and is evacuated from there and replaced by a pure inert gas. The quantity of the inert gas being introduced is a multiple of the quantity of gas flowing out of the container into the liquid container. By means of this inert gas, a constant pressure is exerted on the gas mixture consisting of inert gas and residual air. This pressure contributes to keep as low as possible the share of residual air in the gas chamber of the filler tank in order to protect the beverage in the filler tank against air concentration. This gas mixture contained in the gas chamber is evacuated indirectly to the outside by using it for rinsing the following containers before its evacuation. The disadvantage of such a method for removing the air from the container is the comparatively high equipment expense needed for evacuating the containers, and also the fact that the inert gas used as pressurizing gas cannot be reused because it escapes into the free atmosphere during the rinsing of the bottles together with the atmospheric air.

German Pat. No. 697 703 also discloses a method for filling containers, according to which a container filled with atmospheric air is prerinsed by means of an inert gas, for instance carbon dioxide, to push out part of the air existing in the container. Following this, the containers to be filled are emptied in order to then be pressurized with an inert gas. Disadvantageous here too are the expensive equipment needed for the emptying of containers, and the need for large quantities of rinsing gas and pressurizing gas. In addition, the evacuation operation increases considerably the filling time of a container, which has a negative impact on the filling costs.

In a publication of the company Holstein & Kappert Maschinenfabrik Phoenix GmbH, Dortmund, Issue 28, 1960/IV, another method is described in which the containers to be filled are first evacuated before being actually pressurized with an inert gas. This procedure prevents the extensive diluting of the inert gas by the air brought along by the bottles. Also, the inert gas used for pressurizing may be maintained relatively well in its purity in the filler tank during the entire filling operation. Disadvantageous are again the lengthy evacuation process, for instance one second for a half liter bottle, and the high consumption of inert gas.

German Pat. No. 942 437 discloses a method with which the air located in the container to be filled is pushed to the outside by a gas, for instance carbon dioxide, without using pressure, before the container is filled with a liquid. The chasing gas is evacuated by pipes leading to the outside. Since the carbon dioxide flows freely to the outside, it has to be replaced constantly.

German Offenlegungsschrift No. 2 123 255 describes a filling method for beverages containing carbon dioxide. A container filled with atmospheric air is pressurized with an inert gas without previous evacuation, and is then filled with a liquid. While the containers are being filled, the air inside these containers is pushed to the outside through the gas channel of the filling valve and then through the air vent valve of the filler tank by a correspondingly large quantity of inert gas. At the same time, an equal quantity of an inert gas is fed into the filler tank. This quantity of an inert gas is added to compensate for the additional inert gas lost to the outside by being chased, together with the air, through an air vent valve. Because of the relatively high pressure prevailing in a filling tank, a considerable quantity of inert gas is also pushed outside during the chasing operation. This inert gas has to be replaced by a correspondingly large quantity of inert gas made available to the filling process.

The object of the present invention, on the other hand, is to set forth a counterpressure filling method and to provide a device needed for this method. With this method, an inert gas used for rinsing and pressurizing the containers to be filled needs to be replenished only in relatively small quantities because of the small loss, and requires only a minimum equipment expense.

This object, and other objects and advantages of the present invention, will appear more clearly from the following specification in connection with the accompanying drawings, in which.

Figure 1:
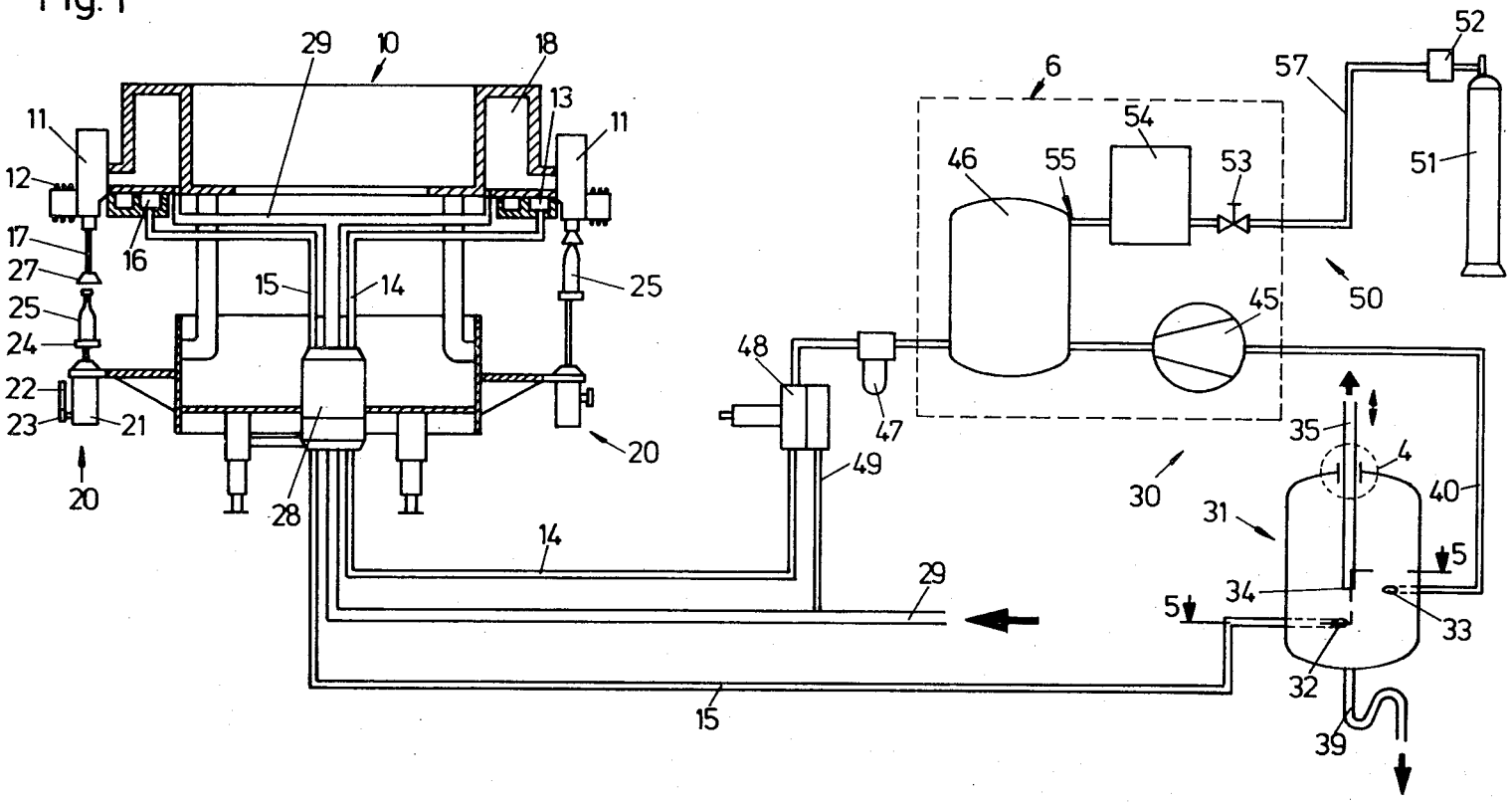
FIG. 1 is a schematic diagram of a counterpressure filling machine connected to a device for recovering and preparing the pressurizing gas.

The method of the present invention is characterized primarily in that at least the mixture of inert gas and air pushed out of the container during the filling of the liquid at each filling station is centrally collected and is subjected in at least one collector container to at least one gravity effect for partial separation of the lighter gas components, and in that the thus obtained mixture, comprising predominantly inert gas, is returned to the filling process as a pressurizing gas mixture, and possibly partly as rinsing gas, after the addition of inert gas.

The partial separation of atmospheric air and inert gas by means of gravity is based on the knowledge that the air mixture has a lower specific weight than an inert gas, such as carbon dioxide. This mixture of atmospheric air and inert gas is introduced into a collector container where no pressure has been allowed to build up. In this container, an automatic separation takes place because the lighter medium floats upwards. The mixture thus obtained, which retains a harmless share of residual atmospheric air, is enriched with a corresponding quantity of pure inert gas and is then returned to the filling process.

In a particularly advantageous step, an electrically controlled introduction of an inert replacement gas, for the purpose of increasing the share of inert gas in the mixture obtained, may take place on the way between the collector container and the buffer tank. In this way, the introduction of an inert replacement gas for the purpose of increasing the share of the inert gas in the mixture obtained may occur between the collector container and the transport device for the compressible mixture. In another advantageous step of this method, the feeding of an inert replacement gas may occur between the transport device for the compressible mixture and the buffer tank. In a further advantageous step, the inert replacement gas may be fed into the mixture obtained directly in the buffer tank.

Particularly advantageous is the electrical control of the quantity of the inert replacement gas to be added to the mixture obtained to ensure that it corresponds to the volume of the container to be filled.

In another advantageous procedural step, the mixture obtained by additional enrichment with the inert replacement gas may be conducted into the collector container under a lower pressure than exists in this container, for the purpose of pressure control in the pressure container.

In a further advantageous procedural step, the inside of the container to be filled may still be connected with the outside atmosphere during the first pressurizing phase in order to expel the atmospheric air inside the container by means of an inflowing mixture composed mostly of inert gas and a small part of air.

According to further features of the method of the present invention, the gravity effect may be carried out essentially at atmospheric pressure and with free outlet for the lighter gas components into the atmosphere.

The gravity effect may be achieved essentially by vertical deposit of the inert gas/air mixture coming from the filling process, accompanied by rotation about a vertical axis with tangential feeding of the inert gas/air mixture, tangential evacuation of the obtained mixture, composed mostly of inert gas, and upper evacuation of the lighter gas components. Inside the collector container, a stream of the inert gas/air mixture coming from the filling process is rotated as gravity effect in a whirl similar to a cyclone about a vertical axis, while the evacuation of the lighter gas components takes place essentially axially in an upper point located essentially in the whirl axis.

The gravity effect may react on the inert gas/air mixture coming from the filling process in a manner similar to that of a centrifuge. The mixture obtained by the gravity effect, and comprising mainly inert gas, may be collected in a buffer volume before being returned to the filling process, and the further addition of inert gas may occur between the gravity treatment and this buffer volume, or at this buffer volume itself. Between the gravity effect and the buffer volume, a pressure increase may be realized in the mixture obtained through the gravity effect and containing mostly inert gas. The addition of inert gas may take place before or after the pressure increase. The pressure increase in the mixture obtained through the gravity effect, and containing mostly inert gas, may be to 2 to 5 bar, preferably to essentially 3 bar. Two or more gravity effect stages of the same or different types may be arranged one after the other. The same recovered and prepared inert gas/air mixture may be used in the filling process both as rinsing gas and as pressurizing gas.

The gas mixture, consisting mostly of inert gas and obtained through the gravity effect, may be used as rinsing gas without addition of inert gas, and as pressurizing gas with the addition of inert gas. A gas mixture consisting mostly of inert gas and resulting from a first stage gravity effect may be used as rinsing gas, and a mixture consisting mostly of inert gas and resulting from the last gravity effect stage may be used as pressurizing gas after addition of inert gas.

The separated lighter gas components, possibly after additional preparation for increasing the share of inert gas, may be used as rinsing gas, and the mixture containing mostly inert gas and obtained through gravity effect may be used as pressurizing gas after further addition of inert gas. A sterilization of the gases may be effected before the rinsing gas and the pressurizing gas are introduced into the containers to be filled.

The inventive procedure may be carried out with a device for one or more conventional counterpressure filling machines, the filling elements of which have devices for the centered, sealed attachment of a container to be filled, as well as pipes and controlled valves for the feeding of a rinsing gas, a pressurizing gas, and a liquid to be filled into containers. Also associated with the filling elements are lifting and lowering devices designed for attaching the container to be filled in a not yet sealed rinsing position and in a sealed pressurizing and filling position, and for lowering the filled container. According to the invention, such a device is characterized primarily by the following features:

(a) at each filling element, a recovery and preparation device for the gas mixture is attached through the collector channel to the return line for the mixture of inert gas and air expelled at least during the filling of a container with a liquid;

(b) the feeding line or lines for rinsing gas and pressurizing gas of each filling element is or are attached to this recovery and preparation device; and (c) this recovery and preparation device includes at least one collector container with devices for producing a gravity effect on the gas mixture conducted to it, and at least one outlet for lighter gas components and an outlet for a mixture which is predominantly inert gas; also included are devices for returning this mixture of mainly inert gas to the filling elements, and devices for the dosed introduction of the inert gas into this mixture of predominantly inert gas.

According to further features of the invention device, the collector container may perform essentially the function of a settling tank for the return gas coming from the counterpressure filling machine, with a return gas inlet arranged in the lower area, with at least one outlet, staggered in height in relation to the return gas outlet, for the gas mixture consisting mainly of inert gas, and with at least one outlet, for the lighter gas components, arranged above the return gas inlet and the outlet or outlets for the gas mixture of mainly inert gas.

The collector container, with circular cross section, vertically arranged middle axis, and tangentially attached inlet, may be designed as a whirl chamber, similar to a cyclone, for the return gas coming from the counterpressure filling machine. The outlet for the gas mixture of predominantly inert gas may also be essentially tangentially attached to the circumferential wall of the collector container.

The outlet for the gas mixture of predominantly inert gas may be arranged above the return gas inlet. The outlet element connecting the inside of the collector container with the free atmosphere may be an essentially vertically arranged pipe which, together with its inlet arranged inside the collector container, may be adjustable in height by means of a clamping and sealing connection.

The outlet for the lighter gas components may be designed as a lockable opening in the circumferential wall of the collector container. A number of various openings may be arranged all over the height of the collector container.

A feeding pipe coming from the inert gas source may be divided into two flow routes, in each of which an electrically controllable shutoff valve may be installed. The two shutoff valves may be controlled in such a way by a performance measuring device of the counterpressure filling machine that during low performance of the counterpressure filling machine, only one of the shutoff valves is open, and during high performance of the counterpressure filling machine, both shutoff valves are open. A T-part may be attached to the electrically controllable shutoff valves, this T-part again uniting the two flow routes; and an adjustable flow control valve may be installed in each branch of the T-part attached to the shutoff valves.

A liquid outlet or discharge may be installed at the lowest point of the collector container.

The devices for returning the gas mixture of predominantly inert gas may include a buffer tank as well as a pressure regulating valve which conducts the prepared gas mixture of predominantly inert gas into the pressurizing line of the counterpressure filling machine.

The devices for returning the gas mixture of a predominantly inert gas may also include a gas compressor, preferably a gas compressor which turns itself off automatically when a predetermined excess pressure is exceeded, and the devices for the dosed feeding of inert gas before or after the gas compressor may flow into the devices for uniting the gas mixture of a predominantly inert gas, possibly into the buffer tank.

In the outlet pipe of the buffer tank, a sterilization filter may be installed.

The device for the dosed feeding of inert gas may be designed as a regulating valve which interrupts the feeding of inert gas automatically when a predetermined excess pressure is exceeded.

Referring now to the drawings in detail, as shown in FIG. 1, the pressurizing gas line 14 and return gas line 15 of a counterpressure filling machine, for instance a three-chamber counterpressure filling machine 10, are connected to a recovery and preparation device 30 by means of a distributor 28. The embodiment shown here is a rotating filling machine for filling material in liquid form, particularly beverages, and has an annular filling material chamber 18 on the outer circumference of which, all around, a plurality of filling elements 11 are installed. Each filling element is equipped with a filling tube 17, arranged in an essentially vertical position, and a vertically adjustable centering and sealing tulip 27. To each filling element 11 is assigned a lifting and lowering device 20 having a lifting cylinder 21 and a support plate 24 for accommodating a respective container 25 to be filled, for instance a bottle. The lowering and lifting may occur in such a way that the lifting cylinder is constantly subjected to pressure medium in the direction of the lifting, and that in the area of the container outlet and container inlet a lifting cylinder control cam 22 is installed on which run lifting cylinder control rollers 23 which are attached to the lifting cylinders 21 in order to lower each support plate 24 carrying a filled container 25 prior to the outlet, and to allow each support plate 24 in the lowered position, at the machine inlet, to receive a container to be filled, and to lift it at the intended distance from the inlet together with the container to the corresponding filling element 11.

The annular filling material chamber 18 is filled through a filling material concuit 29 by the distributor 28. The pressurizing gas line 14 ends in an annular distributor channel 13, while the return gas line 15 is connected to an annular collection channel 16.

Figure 3:
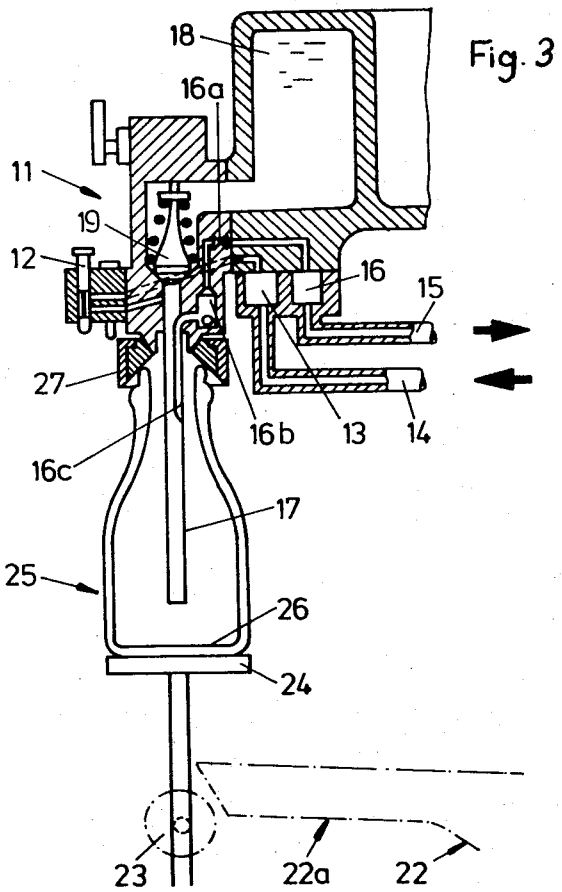
FIG. 3 is a filling element in the same representation as FIG. 2; but in the pressurizing position.
Figure 2:
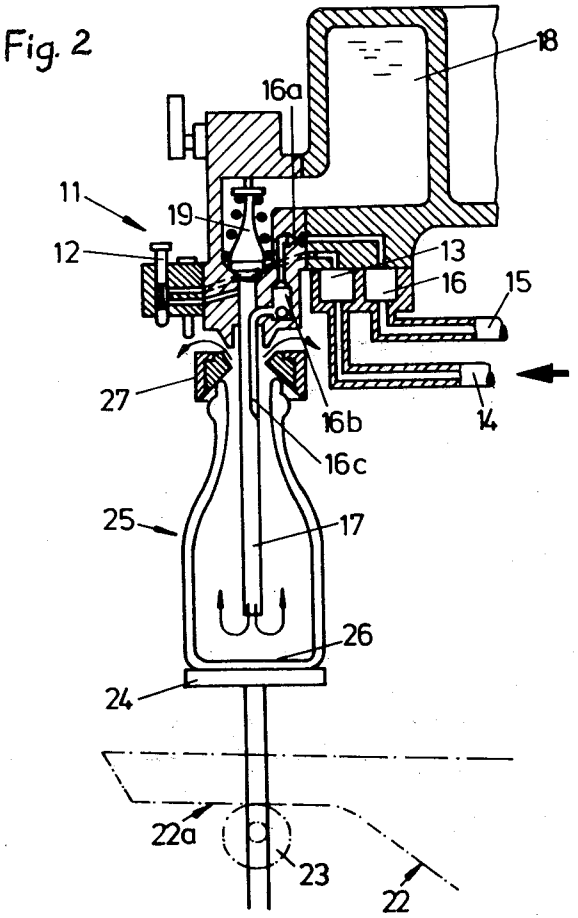
FIG. 2 is a vertical section of a filling element of the counterpressure filling machine according to FIG. 1, in the rinsing position.

As shown in FIGS. 2 and 3, each filling element 11 is equipped in the conventional manner with a liquid flow valve 19 which lifts from the seat during pressure equalization under the action of a spring, as well as with a pressurizing valve 12. The pressurizing valve is located in the pressurizing line between the annular distributor channel 13 and its opening into the filling tube 17. The annular collection channel 16 of the return gas line is connected by a channel, a restrictor **16*a*, and a check valve 16*b* to a conventional return gas side channel 16*c* of the filling tube 17**.

As FIG. 2 also shows, the lifting cylinder cam 22 has an extension **22*a* which holds the support plate 24 with the container 25 to be filled during a predetermined part of the path of the filling element in a partly lifted position, so that the filling tube 17 extends downward already into the area of the container bottom 26, but the upper rim of the container, and the centering and sealing tulip resting thereon, are not yet pressed into the sealing position at the lower side of the filling element 11. With the pressurizing valve 12 open, this will cause the gas mixture introduced into the inside of the container 25 by the filling tube 17 to rinse out the air contained inside the container 25 and to push it outside between the centering and sealing tulip 27 and the underside of the filling element 11. By introducing the gas mixture into the area of the container bottom 26, this rinsing operation already pushes the lighter gas components upwards and rinses or flushes them out, while the heavier inert gas, particularly carbon dioxide, remains mainly inside the container 25**.

As shown in FIG. 3, the rinsing operation described above and indicated in FIG. 2 converts into the pressurizing operation by the fact that during the rotating movement of the filling machine, the lifting cylinder control roller 23 runs off the extended part **22*a* of the lifting cylinder cam 22. This causes the support plate 24 with the container 25 standing on it to be lifted sufficiently so that the upper rim of the container is lodged tightly against the centering and sealing tulip 27, and the centering and sealing tulip 27 is pressed tightly against the underside of the filling element 11. Since the pressurizing valve 12 is still open in this position, the additional introduction of the pressurizing gas leads to a pressure increase, i.e. the pressurizing of the interior of the container 25 to the gas pressure which was indicated or selected in the pressurizing system, while insignificant amounts of the pressurizing gas escape through the restrictor 16***a* into the annular collection channel 16.

A corresponding pressure as in the pressurizing gas system is maintained in the annular filling material chamber 18, as is explained below. When the pressurizing pressure inside the container 25 is reached, the liquid flow valve 19, released for opening, lifts off its seat under the pressure from its spring and thus initiates the filling operation, prior to which the pressurizing valve 12 was closed.

By feeding the pressurizing gas into the area of the container bottom 26 during the pressurizing operation, a partial separation of the gas components is again obtained, to the extent that the heavy gas components, i.e. the heavy inert gas, collects mainly at the lower part of the container 25 and thus shields off the filling material arriving through the filling tube 17 from the lighter gas components, in particular from the remaining oxygen of the air. This collection of the inert gas also remains intact above the level of the liquid gathering in container 25.

During the filling operation, the pressurizing gas contained inside the container 25 is pushed through the check valve 16*b* and the restrictor 16*a* into the annular collection channel 16 and from there into the return gas line 15.

After the conclusion of the filling operation, and to be able to withdraw the filled container 25, a pressure equalization is performed directly with the atmosphere or through a pipe which is not shown in detail and which leads to the annular collection channel 16. In the area of the restrictor 16*a*, this pipe opens into the line containing this restrictor. Before this pressure equalization is performed, the filling material mounting in the return gas side channel 16*c* automatically closes the check valve 16*b* and thereby also the annular collection channel 16 as well as the return gas line 15. By closing the pressurizing valve 12 before the arrival of the filling material, the annular distributor channel 13 and the pressurizing gas line 14 are closed against outer influences, in particular against the escape of pressurizing gas.

FIG. 1 also shows that the return gas line 15, which leads through the distributor 28, ends in an accumulator or collector container 31 of the recovery and preparation device 30. The inlet 32 of the return gas line 15 is located in the lower part of the collector container 31. Also located in the lower part of the collector container 31, but at a different height, is an outlet 33 for such a gas mixture which contains mainly inert gas. In the example shown in FIG. 1, an outlet 34 is located above the inlet 32 and the outlet 33 in the vertical middle axis of the collector container 31. In the example shown, this outlet 34 for lighter gas components leads to the outside into the atmosphere.

An evacuation or discharge pipe 40 leading to a gas condenser or compressor 45 is attached to the outlet 33 for the gas mixture predominantly of inert gas. Attached to the gas compressor 45, which may be a simple rotary pump or, in a preferred embodiment, a compressor which turns itself off automatically when a predetermined excess pressure is exceeded, and turns itself on automatically if the pressure falls below a certain level, is a buffer tank or reservoir 46 in which the obtained gas mixture, which is predominantly inert gas, is maintained at an excess pressure of 2 to 5 bar, for instance 3 bar.

For further preparation, additional inert gas is added to the gas mixture of predominantly inert gas. This is done in the example of FIG. 1 at the buffer tank 46. For this purpose, an inert gas feeding and dosing device is attached to the buffer tank 46. The inert gas feeding and dosing device 50 comprises in this example an inert gas source 51, for instance a carbon dioxide bottle with a pressure-reducing valve 52, a shutoff valve 53, a dosing device 54 proper, and an introduction device 55. As explained below, the introduction of the additional inert gas into the transfer pipe 40 may also take place before or after the gas compressor 45.

As FIG. 1 also shows, a sterilization filter 47 is installed in the outlet pipe after the buffer tank 46 as the last preparation step for the rinsing and pressurizing gas which is to be returned to the counterpressure filling machine 10. Finally, the rinsing and pressurizing gas is conducted through a pressure regulator 48 to adjust its pressure to the value desired at the counterpressure filling machine. The pressure regulator 48 is connected to the filling material pipe 29 by the pipe 49 and causes the pressure in the rinsing gas/pressurizing gas system to be adjusted to the pressure conditions prevailing in the filling material conduit 29 or in the filling material chamber 18 of the counterpressure filling machine 10.

Figures 4, 5, 6:
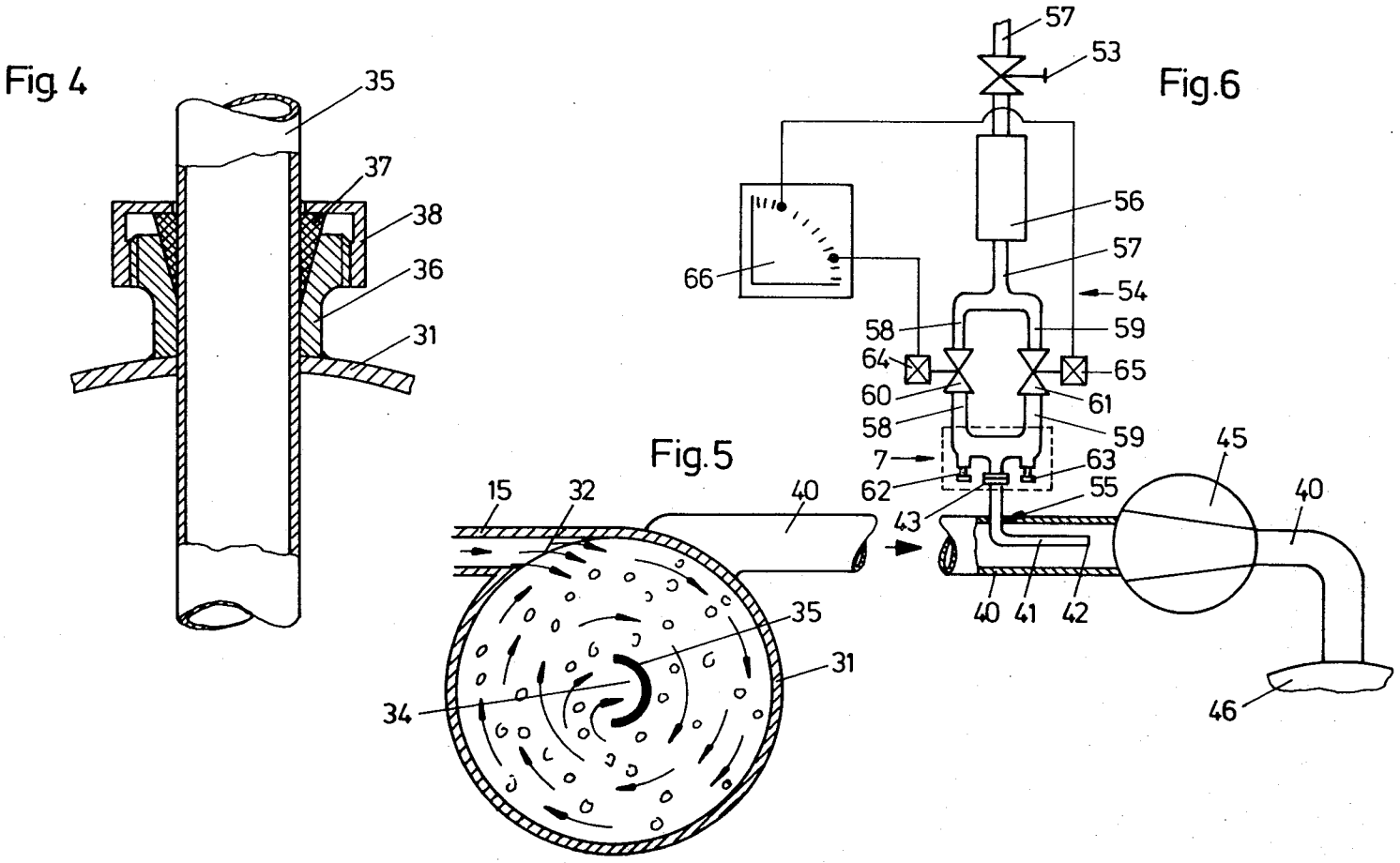
FIG. 4 is a detailed representation of the encircled area 4 in FIG. 1.
FIG. 5 is a section through the collection container taken along line 5—5 in FIG. 1.
FIG. 6 is a modified design of area 6 in FIG. 1.

As shown in FIGS. 1 and 4, the collector container or accumulator 31 is equipped with a pipe 35, adjustable in its height, which extends in the vertical axis of the container and which forms the outlet for lighter gas components at its lower end. The pipe 35 is held in a nipple 36 attached to, for instance welded on, the top wall of the collector container 31. The passage of the nipple widens conically at the upper end essentially in the area of a threaded flange. In this conically widened passage part, a ring-shaped sealing and clamping element 37 having a wedge-shaped cross section is inserted and pressed in with a tightening nut 38. By loosening the tightening nut 38, the pipe 35 may be adjusted in height by sliding it in the direction of its axis.

At the lowest point of the bottom wall of the collector container 31, a liquid drain or discharge 39 is attached which may function in the manner of a siphon or an automatically acting discharge device.

As shown in FIGS. 1 and 5, the collector container 31 has a circular cross section, and the return line 15 coming from the counterpressure filling machine 10 is attached tangentially at the lower part to the circumferential wall of the collector container 31. This causes the gas mixture entering from the return gas line 15 into the collector container 31 to be put into a whirling motion which, like a cyclone, collects the heavy gas components and, consequently, the heavy inert gas, in the region of the peripheral wall, while the lighter gas components are conducted to the inside of the whirl, and through the outlet 34 and the outlet pipe 35 to the outside. The height adjustment of the pipe 35 should occur in such a way that the outlet 34 is always above the inlet 32 and also above the inlet 33 for the heavy gas components. This makes it possible to take advantage of both the whirl and the gravity to separate the gas mixture components and have the lighter gas components flow out through outlet 34 and outlet pipe 35. The whirl created inside the collector container 31 also causes the liquid particles mixed with the return gas to be thrown against the inner surface of the collector's circumferential wall approximately at the height of the inlet 32, and to be separated from the gas mixture through gravity. Particles of liquid which were swept along collect, therefore, at the bottom of the collector container 31 and are eliminated through outlet 39. The arrangement of outlet 33 for the heavy gas components, above outlet 32 as shown in FIG. 1, assures that no liquid particles, or at most only very small quantities of liquid particles, get into discharge pipe 40.

FIG. 6 shows a modification of the inert gas feeding and dosing device 50. In this example, the feeding point 55 for the inert gas has been placed at a point of the discharge pipe 40 which is located before the gas condenser 45. For this purpose, an inlet pipe 41 is tightly inserted into the discharge pipe 40, for instance welded in, and essentially extends radially into the middle area of the discharge pipe 40, and from there is bent to an outlet end 42 in the direction of the flow of the gas mixture conducted in the discharge pipe 40.

On a flange 43 formed on the inlet pipe 41, the dosing device 54 for the inert gas is attached. In the example presented, this dosing device includes a measuring and indicating device 56 for the quantity of inert gas. Behind this measuring and indicating device 56, the inert gas pipe 57 is divided into two branches 58 and 59. Each of these pipe branches 58 and 59 contains a bypass valve 60 or 61, and a dosing valve 62 or 63. Each of these bypass valves 60 and 61 has an electrical control mechanism 64 and 65. These electrical control mechanisms are controlled by a performance indication device 66 connected to the counterpressure filling machine 10. At low performance, only the bypass valve 60 located in pipe branch 58 is opened, while at high performance of the counterpressure filling machine 10, both bypass valves 60 and 61 are open, i.e. inert gas is fed through both pipe branches 58 and 59, and both dosing valves 62 and 63.

Figure 7:
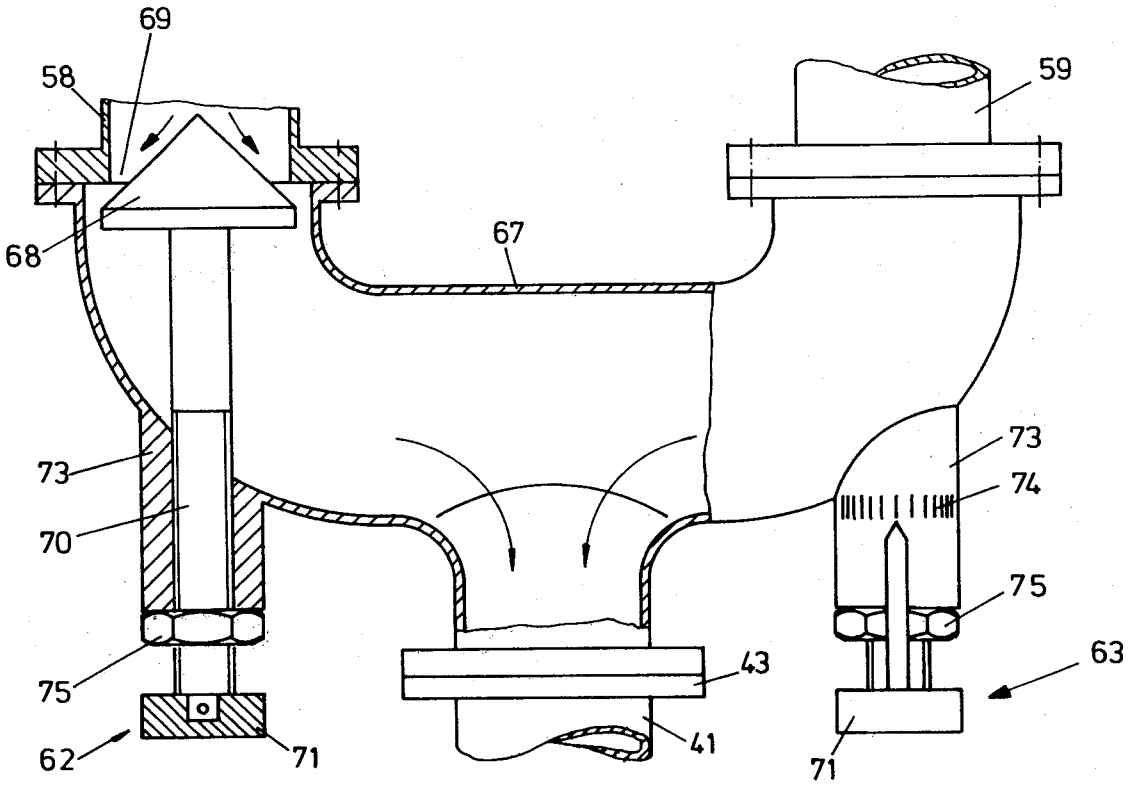
FIG. 7 is an enlarged detailed representation of area 7 in FIG. 6.

As shown in FIG. 7, the two dosing valves 62 and 63 are placed in a lower T-pipe 67, which brings the two pipe branches 58 and 59 together again. Each of these dosing valves 62 and 63 has a needle valve or a valve cone 68 which acts together with the lower outlet cross section 69 of the corresponding pipe branch 58 or 59. The valve cone or the needle valve sits on a finely threaded shaft 70, which carries at its end a knob 71, is held in a finely threaded nut, and is guided in a sleeve 73. The markings 74 on the outside of the sleeve 73 make it possible to read the position of the dosing valve 62 and 63. In addition, the control knob 71 is equipped with a locking device 75 which acts upon the guide sleeve 73. This locking device 75 makes it possible to lock the dosing valves 62 or 63 in position after it has been adjusted.

The presented application examples can be easily modified. For instance, several counterpressure filling machines 10 may be connected to one and the same recovery and preparation device 30. In that case, each attached counterpressure filling machine would have to be equipped with its own pressure regulating valve 48. Furthermore, counterpressure filling machines of different types may easily be attached to one and the same recovery and preparation device 30. The collector container 31 may also be modified in various ways. For instance, the collector container 31 may be constructed in such a manner that the separation of the gas mixture takes place by mere settling through gravity. This would probably require a collector container with a much larger capacity and a somewhat different arrangement of the connection for the pipes 15, 40 and 35. On the other hand, the collector container may also be equipped with much more efficient separation devices for the gas components, for instance with a centrifuge or similar device installed in its interior.

Furthermore, the carbon dioxide bottle 51, or a battery of such bottles, may be replaced as the source of inert gas by a carbon dioxide production installation used in breweries. The inert gas feeding and dosing device 50 is then connected directly to the company power supply. For each type of inert gas source, the dosing device 54 may function as a regulating valve for the inert gas feeding and dosing device 50. The regulating valve automatically interrupts the feeding of inert gas if the predetermined excess pressure is exceeded, and automatically turns on the feeding of inert gas if the pressure is low.

The sterilization filter 47 associated with the inventive device and inserted in the evacuation pipe of the buffer tank 47 eliminates at least the germs from the prepared gas mixture which are harmful to the beverages.

The preceding shows that the inventive method and device, from the pressurizing to the filling of the containers, are capable of capturing the entire mixture of inert gas and air flowing from the containers into the collection channel 16 regardless of whether the mixture accumulates during pressurizing, filling, or discharging, and feeding it to the recovery and preparation device 30.

The present invention is, of course, in no way restricted to the specific disclosure of the specification and drawings but also encompasses any modifications within the scope of the appended claims.

What I claim is:

1. A method of recovering inert gas used during a filling process for pressurizing containers which are to be filled with a liquid, said method including the steps of:

expelling the air found in a container, and pressurizing said container, with a mixture of air and heavy inert gas;

filling said container with said liquid and thus expelling said pressurizing gas mixture;

centrally collecting said expelled gas mixture from a plurality of containers and conveying said mixture to at least one accumulator;

subjecting said pressurizing gas mixture in said at least one accumulator to at least one gravity effect for partially separating off the lighter gas components and producing a mixture of predominantly inert gas;

adding additional inert gas to said mixture of predominantly inert gas; and returning the resulting mixture to said filling process, at least as a pressurizing gas mixture, for use with subsequent containers which are to be filled.

2. A method according to claim 1, which includes the step of carrying out said at least one gravity effect at atmospheric pressure with free access for said lighter gas components to the atmosphere.

3. A method according to claim 2, which includes the step of carrying out said at least one gravity effect by essentially vertical deposit of said pressurizing gas mixture accompanied by tangential feeding of said mixture and rotation thereof about a vertical axis, as well as tangential evacuation of said mixture of predominantly inert gas and upper evacuation of said lighter gas components.

4. A method according to claim 3, which includes the step of effecting said at least one gravity effect by moving a stream of said pressurizing gas mixture in a cyclone-like whirl about a vertical axis, while effecting said evacuation of said lighter gas components essentially axially in an upper location which is essentially in said whirl axis.

5. A method according to claim 2, which includes the step of effecting said at least one gravity effect in a manner similar to that of a centrifuge.

6. A method according to claim 1, which includes the step of collecting said mixture of predominantly inert gas in a buffer tank prior to said step of returning said mixture of predominantly inert gas to said filling process.

7. A method according to claim 6, in which said step of adding additional inert gas to said mixture of predominantly inert gas takes place between said step of subjecting said pressurizing gas mixture to at least one gravity effect and said buffer tank.

8. A method according to claim 6, in which said step of adding additional inert gas to said mixture of predominantly inert gas takes place at said buffer tank.

9. A method according to claim 6, which includes the step of increasing the pressure of said mixture of predominantly inert gas between said step of subjecting said pressurizing gas mixture to at least one gravity effect and said buffer tank.

10. A method according to claim 9, which includes the step of adding additional inert gas to said mixture of predominantly inert gas prior to said step of increasing the pressure of said mixture of predominantly inert gas.

11. A method according to claim 9, which includes the step of adding additional inert gas to said mixture of predominantly inert gas after said step of increasing the pressure of said mixture of predominantly inert gas.

12. A method according to claim 9, which includes the step of increasing the pressure of said mixture of predominantly inert gas to two to five bar.

13. A method according to claim 12, which includes the step of increasing said pressure to essentially three bar.

14. A method according to claim 1, which includes the step of subjecting said pressurizing gas mixture to at least two subsequent gravity effect stages.

15. A method according to claim 1, which includes the step of using said returned mixture of predominantly inert gas in said filling process both as rinsing gas and as pressurizing gas.

16. A method according to claim 14, which includes the step of using a portion of said mixture of predominantly inert gas as rinsing gas prior to said step of adding additional inert gas to said mixture of predominantly inert gas.

17. A method according to claim 16, which includes the steps of removing a mixture of predominantly inert gas from a first stage of said gravity effect, using said removed mixture as rinsing gas, removing a mixture of predominantly inert gas from the last stage of said gravity effect, adding additional inert gas to said last mentioned mixture of predominantly inert gas, and using the resulting mixture as pressurizing gas.

18. A method according to claim 1, which includes the step of using said separated-off lighter gas components as rinsing gas.

19. A method according to claim 18, which, prior to introducing said rinsing gas and said pressurizing gas into said containers to be filled, includes the steps of sterilizing said gases.

20. A device associated with counterpressure filling machines having filling elements for containers which are to be filled with a liquid, including a conduit for supplying said liquid to respective filling elements, said device comprising:

a collection channel connectable with each of said filling elements for receiving therefrom a mixture of inert gas and air expelled at least during filling of a container with liquid;

a return gas line connected to said collection channel for receiving said gas mixture therefrom;

a supply line connectable with each of said filling elements for supplying rinsing gas and pressurizing gas thereto; and a recovery and preparation device which is connected to said return gas line for receiving said gas mixture therefrom, and to said supply line for supplying rinsing gas and pressurizing gas thereto, said recovery and preparation device including at least one accumulator, which is connected to said return gas line for receiving said gas mixture therefrom, said at least one accumulator including means for producing a gravity effect on said gas mixture, at least one outlet for lighter gas components, and an outlet for a mixture of predominantly inert gas, said recovery and preparation device further including devices for returning said mixture of predominantly inert gas to said supply line, and devices for the dosed introduction of inert gas into said mixture of predominantly inert gas.

21. A device according to claim 20, in which said accumulator is essentially a settling tank for said gas mixture in said return gas line and includes a return gas inlet arranged in the lower area thereof, with said outlet for a mixture of predominantly inert gas being arranged so as to be staggered in height relative to said return gas outlet, and with said at least one outlet for lighter gas components being arranged above said return gas inlet and said outlet for a mixture of predominantly inert gas.

22. A device according to claim 20, in which said accumulator forms a whirl chamber, similar to a cyclone, and has a circular cross section, a vertically arranged middle axis, and a tangentially arranged inlet for said gas mixture from said return gas line.

23. A device according to claim 22, in which said outlet for a mixture of predominantly inert gas is tangentially attached to the circumferential wall of said accumulator.

24. A device according to claim 22, in which said outlet for a mixture of predominantly inert gas is arranged above said return gas inlet.

25. A device according to claim 22, which includes a vertically arranged pipe for connecting the interior of said accumulator with the free atmosphere, said outlet for lighter gas components forming an end of said pipe in communication with the interior of said accumulator, said pipe being adjustable in height by means of a clamping and sealing connection associated with said pipe and said accumulator.

26. A device according to claim 20, in which said outlet for the lighter gas components is a lockable opening provided in the circumferential wall of said accumulator.

27. A device according to claim 26, which includes a plurality of different openings arranged over the height of said accumulator.

28. A device according to claim 20, in which said devices for the dosed introduction of inert gas into said mixture of predominantly inert gas includes a source of inert gas, and a feed pipe connected to said inert gas source and operatively connected to said supply line, said feed pipe being divided into two branches, each of said branches being respectively provided with an electrically controllable shutoff valve.

29. A device according to claim 28, in which said two shutoff valves are controlled in such a way by a performance measuring device of said counterpressure filling machine that during low performance of said counterpressure filling machine, only one of said shutoff valves is open, and during high performance of said counterpressure filling machine, both shutoff valves are open.

30. A device according to claim 29, which includes a T-pipe having two branches, each branch of which is connected to a respective shutoff valve, said T-pipe again uniting said branches of said feed pipe, each branch of said T-pipe being provided with a respective flow control valve.

31. A device according to claim 20, in which the lowest point of said accumulator is provided with a liquid discharge.

32. A device according to claim 20, in which said devices for returning said mixture of predominantly inert gas to said supply line include a buffer tank and a pressure regulating valve for conducting said mixture of predominantly inert gas to said supply line.

33. A device according to claim 29, in which said devices, for returning said mixture of predominantly inert gas to said supply line include a gas compressor arranged between said accumulator and said buffer tank, and in which said devices for the dosed introduction of inert gas into said mixture of predominantly inert gas is associated with said gas compressor.

34. A device according to claim 33, in which said gas compressor is a gas compressor which turns itself off automatically when a predetermined excess pressure is exceeded.

35. A device according to claim 33, which includes a sterilization filter interposed between, and in communication with, said buffer tank and said pressure regulator.

36. A device according to claim 33, in which said devices for the dosed introduction of inert gas into said mixture of predominantly inert gas includes a regulating valve which interrupts the feeding of inert gas automatically when a predetermined excess pressure is exceeded.

* * * * *